United States Patent [19]

Beideck

[11] Patent Number: 5,022,632

[45] Date of Patent: Jun. 11, 1991

[54] POST PULLING APPARATUS WITH INTERCHANGEABLE WORKING HEADS FOR PULLING DIFFERENT TYPES OF POSTS

[76] Inventor: Mark E. Beideck, 903 E. 15th St., McCook, Nebr. 69001

[21] Appl. No.: 559,192

[22] Filed: Jul. 27, 1990

[51] Int. Cl.[5] ..... B25B 1/04

[52] U.S. Cl. ..... 254/30; 254/132

[58] Field of Search ..... 254/30, 31, 131, 132, 254/133, DIG. 1, 29 R

[56] References Cited

U.S. PATENT DOCUMENTS

| | | | |
|---|---|---|---|
| 90,559 | 5/1869 | Knott | 254/132 |
| 580,337 | 4/1897 | Smith | 254/31 |
| 1,778,682 | 10/1930 | McManus | 254/132 |
| 2,926,890 | 3/1960 | Majors | 254/132 |
| 4,191,360 | 3/1980 | Morrison | 254/129 |

*Primary Examiner*—Robert C. Watson

*Attorney, Agent, or Firm*—John R. Flanagan

[57] ABSTRACT

A post pulling apparatus for pulling different types of posts includes an actuating device and different working heads. The actuating device is manually operable repetitively through a succession of work-producing strokes of movement. The working heads have different configurations for engaging and pulling different types of posts, such as a cross-sectional T-shaped metal post, a round wood post, and a rod-like metal electric fence post. The different working heads can be interchanged with one another in connected relation with an end of the actuating device and coupled with the respective post corresponding to the particular working head for engaging and lifting the post during each work-producing stroke of movement of the actuating device.

18 Claims, 4 Drawing Sheets

POST PULLING APPARATUS WITH INTERCHANGEABLE WORKING HEADS FOR PULLING DIFFERENT TYPES OF POSTS

BACKGROUND OF THE INVENTION

1. Field of the Invention

The present invention generally relates to removal of fence posts and, more particularly, is concerned with a post pulling apparatus with interchangeable working heads for pulling and removing different types of fence posts.

2. Description of the Prior Art

Different types of fence posts are employed in many different applications along highways, on farms and ranches, and at construction sites. Most types of posts are relatively easy to install but ordinarily are more difficult to remove, requiring the expenditure of more time and effort in their removal than installation.

In an attempt to reduce this difficulty, many different apparatuses have been proposed in the prior art for pulling and removing posts. Exemplary prior art apparatuses are described and illustrated in Sanders U.S. Pat. No. (2,377,652), Lundgren et al (2,777,726), Kohorst (2,826,392), Michalak (2,994,510), King (3,779,516), Skinner (3,991,976), Boardman (4,040,601), Parker (4,161,310), Keller (4,726,565) and Hoff (4,738,433). Many of these prior art apparatuses, such as the ones disclosed by the Sanders, Lundgren et al, Kohorst, Michalak, Parker, Keller and Hoff patents, employ an upright support member having a base resting on the ground and a lever arm pivotally mounted to the upper end of the support member, and a working head pivotally attached to the end of the lever arm and coupled about the post to be pulled such that by actuating the lever arm in a "jacking" type motion the post is lifted and dislodged via the working head from the ground.

These prior art apparatuses probably operate satisfactorily and generally achieve the intended result of pulling posts. However, many are limited in the sense that they employ only a single working head adapted for pulling a specific type of post, whereas, for example on farms and ranches, typically different types of posts will be used to fulfill different fencing requirements and needs. Given the limitation of prior art apparatuses, a separate entire apparatus would have to be available to use with each different type of post.

Consequently, a need still exists for a post pulling apparatus which will effectively handle the different types of posts typically used in fencing applications on farms and ranches, along highways, and at construction sites.

SUMMARY OF THE INvENTION

The present invention provides a post pulling apparatus designed to satisfy the aforementioned needs. Unlike the prior art apparatuses, the post pulling apparatus of the present invention employs several different interchangeable working heads on a universal actuating device for pulling different types of posts, such as a cross-sectional T-shaped post, a round wood post, and a rod-like electric fence post.

Accordingly, the primary feature of the present invention is a post pulling apparatus for pulling different types of posts. The pulling apparatus comprises: (a) a universal actuating device repetitively operable through a succession of motion-producing strokes; and (b) a plurality of working heads of different configurations for pulling different types of posts. The working heads are interchangeable with one another in a connected relation with the actuating device for coupling with and for engaging and lifting the different types of posts corresponding to the different working heads during each motion-producing stroke of the actuating device.

More particularly, the actuating device includes an upright support member having an upper end and a base mounted at a lower end for resting on the ground, and a lever arm having opposite ends and being pivotally mounted to the upper end of the support member at a location spaced substantially nearer to one of the opposite ends than the other of the opposite ends. Each of the working heads is pivotally attached to the one of the opposite ends of the lever arm. Each working head has portions that engage the respective type of post at two locations spaced from one another axially along the post and on opposite sides of the post. Then, by actuating the lever arm in a "jacking" type motion, the working head is forced into a cocked engagement against the planted post as the head is moved upwardly by the lever arm, causing binding of the post between the two spaced portions of the head, which results in gripping of the post by the head and lifting and dislodging of the post from the ground.

Other features of the present invention are the different working heads of the post pulling apparatus. A first of the working heads includes a support member having opposite upper and lower edges and opposite front and rear sides, and a pair of guide members rigidly attached to the front side of the support member closer to the lower edge than upper edge thereof and projecting in a converging relationship to one another from the front side of the support member so as to form with the support member a triangular-shaped channel. The first working head is capable of receiving and capturing a cross-sectional T-shaped post in the channel and engaging and lifting the post during each work-producing stroke of movement of the actuating device.

A second of the working heads includes a guide member having a bight portion with opposite front and rear sides and opposite leg portions rigidly attached to the bight portion and extending generally parallel to one another away from the front side of the bight portion. The leg portions have at least one pair of transversely aligned openings formed through the leg portions. A closure member is insertable through the aligned openings in the leg portions of the guide member so as to form with the guide member a channel for receiving and capturing a wood post in the channel. A piercing element rigidly attached on the front side of the bight portion of the guide member and protruding within the channel has an upper edge capable of penetrating the wood post. The second working head is thus capable of receiving the wood post in the channel and engaging and lifting the post during each work-producing stroke of movement of the actuating device.

A third of the working heads includes a guide member having opposite upper and lower sides and opposite front and rear ends. The guide member has an internal rim defining at least one aperture through the guide member of larger diameter than a rod-like post to be pulled by the guide member such that an annular gap is present between the post and the internal rim of the guide member defining the aperture. The guide member of the third working head is capable of receiving the rod-like post through the aperture and of engaging and lifting the post during each work-producing stroke of movement of the actuating device.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

In the following description, right hand and left hand references are determined by standing at the rear of the apparatus and facing toward the post to be pulled by using the apparatus. Also, in the following description, it is to be understood that such terms as "forward," "left," "upwardly," etc., are words of convenience and are not to be construed as limiting terms.

Figure 1:
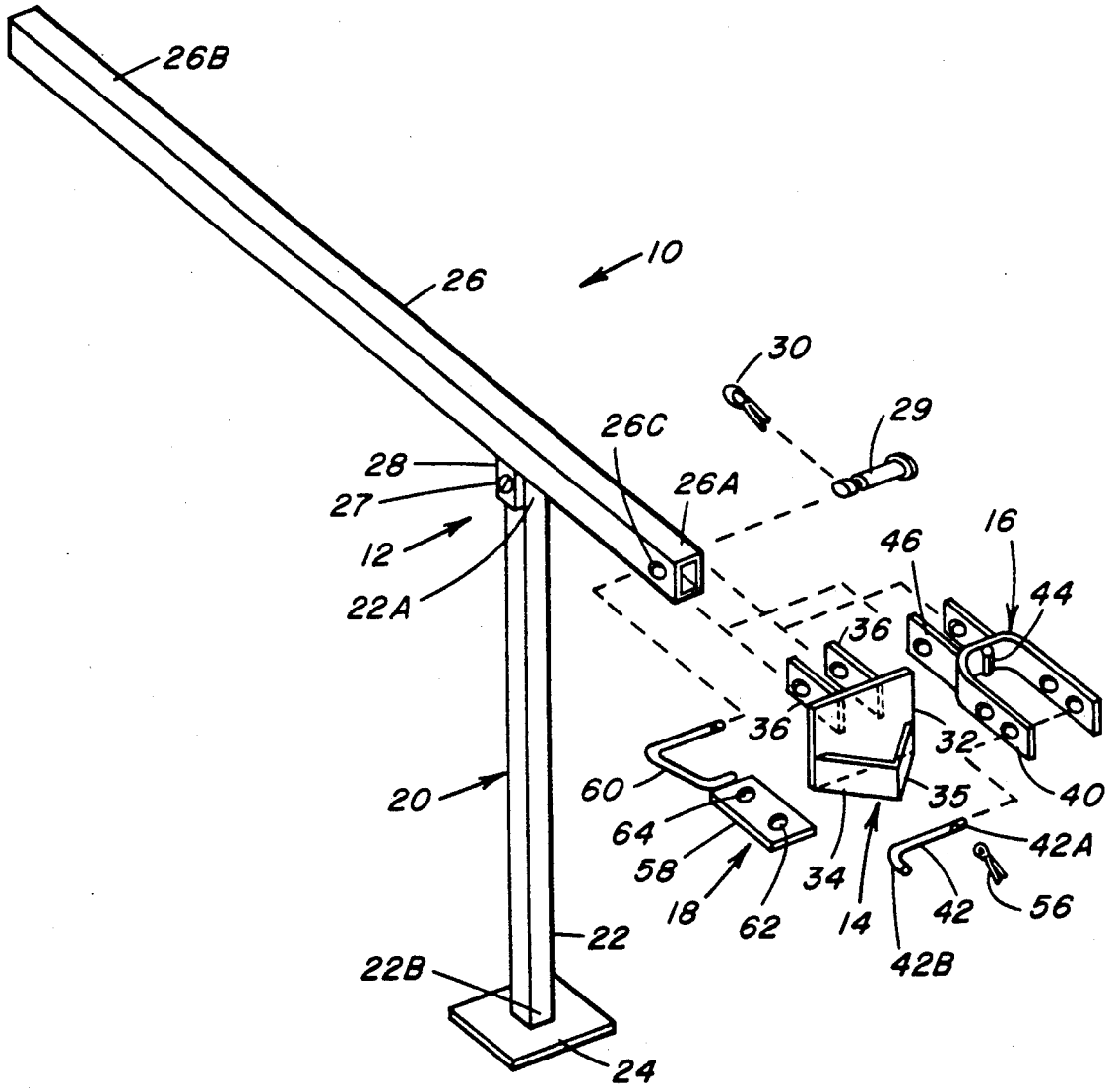
FIG. 1 is an exploded perspective view of a post pulling apparatus of the present invention illustrating a plurality of working heads that can be employed separately with a universal actuating device of the apparatus.

Referring to the drawings, and particularly to FIG. 1, there is shown a post pulling apparatus, generally designated 10, constituting the primary feature of the present invention. In its basic components, the post pulling apparatus 10 includes a universal actuating device 12 and a plurality of different working heads 14, 16 and 18. The working heads 14, 16 and 18, constituting other features of the present invention, are separately employed with the universal actuating device 12. The working heads 14, 16 and 18 have different configurations for pulling different types of posts. Examples of such different types of posts are a cross-sectional T-shaped metal post A seen in FIG. 2, a cylindrical, or round, wood post B seen in FIG. 6, and a rod-like metal electric fence post C seen in FIG. 10.

More particularly, the universal actuating device 12 of the post pulling apparatus 10 is repetitively operable through a succession of jacking-type work-producing strokes of movement. The working heads 14, 16 and 18 are interchangeable with one another on the universal actuating device 12 for engaging and lifting the different types of posts A, B and C corresponding to the different working heads 14, 16 and 18 during each work-producing stroke of movement of the actuating device 12.

Referring to FIGS. 1, 2, 6 and 10, the universal actuating device 12 includes a support member 20 in the form of an upright stand 22 having upper and lower ends 22A and 22B and a base 24 mounted at the lower end 22B of the stand 22 for resting on the ground. The actuating device also includes a lever arm 26 having opposite inner and outer ends 26A and 26B and being pivotally mounted by a pin 27 extending through spaced tabs 28 on lever arm 26 and aligned holes (not shown) through the upper end 22A of the upright stand 22 spaced substantially nearer to the inner end 26A of the lever arm 26 than the outer end 26B thereof. In an exemplary embodiment, the upright stand 22 is a hollow metal tube of square cross-section and the base 24 is a metal plate. The lever arm 26 is a hollow metal tube of square cross-section larger than the tube forming the upright stand 22. The lever arm 26 has a pair of transversely aligned holes 26C at the inner end 26A of the lever arm 26 for pivotally coupling each of the working heads 14, 16 and 18 to the lever arm 26, such as by using a pin 29 and key 30.

Figure 2:
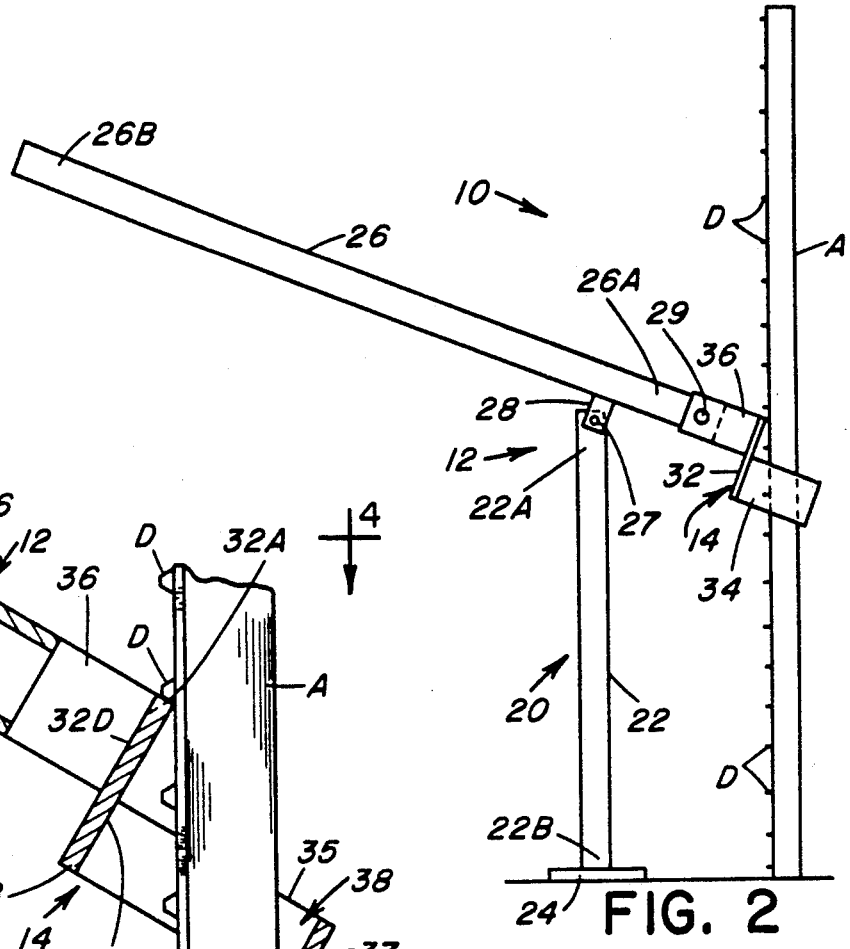
FIG. 2 is a side elevational view of the post pulling apparatus of the present invention employing a first of the working heads of FIG. 1 for pulling a first type of post.

Referring to FIGS. 1–5, there is illustrated the first working head 14 of the present invention being employed for pulling the cross-sectional T-shaped post A as seen in FIG. 2. The first working head 14 is composed of a support member 32, a pair of right and left guide members 34 and 35, and linking means 36. The support member 32 is in the form of a flat plate having opposite upper and lower edges 32A and 32B and opposite front and rear sides 32C and 32D. The right and left guide members 34 and 35 are rigidly attached to the front side 32C of the support member 32 closer to the lower edge 32B than upper edge 32A thereof. The guide members 34 and 35 project in a converging relationship toward one another from the front side 32C of the support member 32 and are rigidly connected at 37 at the intersection of their outer ends so as to form with the support member 32 a triangular-shaped channel 38 for receiving and capturing the "T" post A in the channel 38. As can be understood from FIG. 5, the cross-sectional size of the channel 38 is larger than that of the post A so that the first working head 14 can easily be inserted over and removed from the post A.

The linking means 36 for pivotally coupling the first working head 14 to the actuating device 12 is composed of a pair of laterally spaced parallel links 36 rigidly attached and projecting from the rear side 32D of the support member 32 closer to the upper edge 32A than the lower edge 32B thereof. The links 36 have aligned openings 36A which align with the holes 26C in the inner end 26A of the lever arm 26 for receiving the pivot pin 29 through them to pivotal attach the first working head 14 to the lever arm 26 of the actuating device 12. In an exemplary embodiment, the support member 32, guide members 34 and 35, and links 36 are metal parts which are welded together to from the first head 14.

Figure 3:
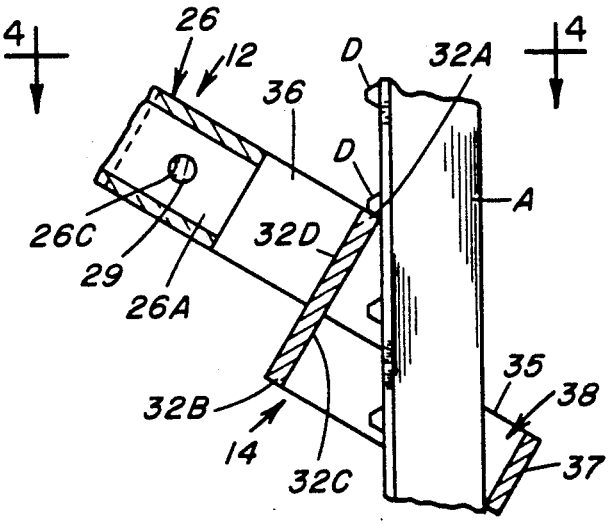
FIG. 3 is an enlarged fragmentary longitudinal sectional view of the apparatus illustrating the first working head engaged with the first type of post as seen in FIG. 2.
Figure 4:
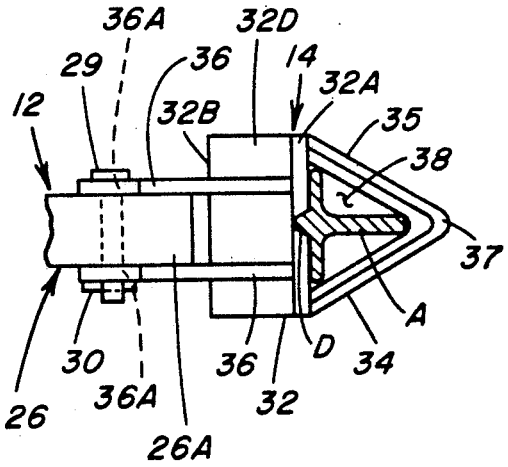
FIG. 4 is a fragmentary top plan view of the apparatus as seen along line 4—4 of FIG. 3.
Figure 5:
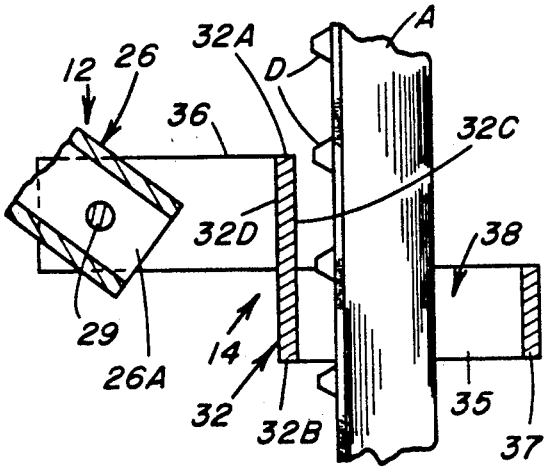
FIG. 5 is a view of the apparatus similar to that of FIG. 3 except showing the first working head disengaged from the first type of post.

As can be seen in FIGS. 3 and 4, with the post A extending through the channel 38, spaced portions defined on the support member 32 and the guide members 34 and 35 engage the post A at two locations spaced from one another axially along the post A and on opposite sides of the post A. Then, during each work-producing stroke of movement of the lever arm 26 of the actuating device 12 the first working head 14 at the two spaced portions thereon is forced against the post in a cocked engagement as the first working head 14 moves upwardly with the inner end 26A of the lever arm 26. The cocked engagement of the first working head 14 with the stationary post A causes binding of the post A in the channel between the two spaced portions of said head, which results in gripping of the planted post A by the head 14 and lifting and dislodging of the post from the ground. One portion of the head 14 which engages the post A is the upper edge 32A of the support member 32 that contacts the underside of one of a plurality of projections D longitudinally spaced along the post A. The other portion of the head 14 which engages the post A is the intersection 37 of the guide members 34 and 35.

Figure 6:
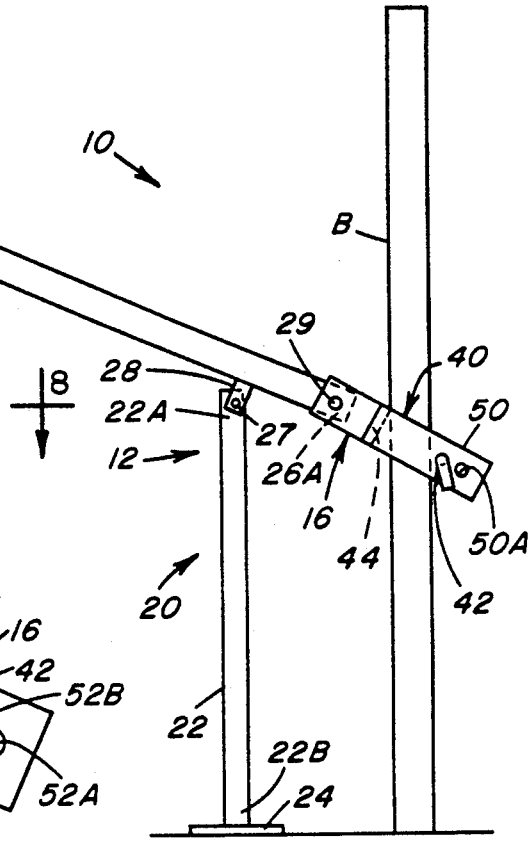
FIG. 6 is a side elevational view of the post pulling apparatus of the present invention employing a second of the working heads of FIG. 1 for pulling a second type of post.
Figure 9:
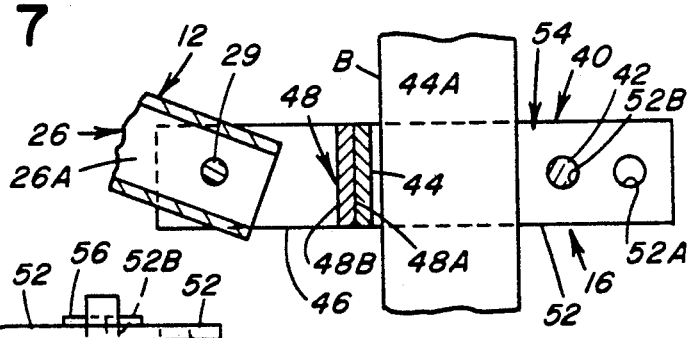
FIG. 9 is a view of the apparatus similar to that of FIG. 7 except showing the second working head disengaged from the second type of post.

Referring to FIGS. 1 and 6–9, there is illustrated the second working head 16 of the present invention being employed for pulling the cylindrical, or round, wood post B as seen in FIG. 6. The second working head 16 is composed of a generally U-shaped guide member 40, a closure member 42, a piercing element 44, and linking means 46. The guide member 40 includes an arcuate bight portion 48 with opposite front and rear sides 48A and 48B and opposite right and left leg portions 50 and 52 rigidly attached to the bight portion 48 and extending generally parallel to one another away from the front side 48A of the bight portion 48. The right and left leg portions 50 and 52 each have pairs of transversely aligned openings 50A, 50B and 52A, 52B formed through the respective leg portions.

The closure member 42 is insertable through a selected pair of the aligned openings 50A, 50B and 52A, 52B in the leg portions of the guide member 40, depending on the diameter size of the round wood post B, so as to form with the guide member 40 a channel 54 for receiving and capturing the wood post B in the channel 54. As can be understood from FIG. 9, the cross-sectional size of the channel 54 is larger than that of the post B so that the second working head 16 can easily be installed about and removed from the post A with the closure member 42 removed. The closure member 42 is retained through the selected openings of the guide member 40 by a key 56 installed through a hole 42A defined in one end of the closure member 42 and a ninety-degree bent portion 42B on the opposite end of the closure member 42.

The piercing element 44 is rigidly attached on the front side 48A of the bight portion 48 of the U-shaped guide member 40. The piercing element 44 protrudes within the channel 54 and has an upper edge 44A capable of penetrating the round wood post B for assisting in lifting of the post B during each work-producing stroke of movement of the lever arm 26 of the actuating device 12. The linking means 46 for pivotally coupling the guide member 40 of the second working head 16 to the lever arm 26 is composed of a pair of laterally spaced parallel links 46 rigidly attached and projecting from the rear side 48B of the bight portion 48 of the U-shaped guide member 40. In an exemplary embodiment, the U-shaped guide member 40, the piercing element 44, and links 46 are metal parts which are welded together to form the second head 16. The closure member 42 is a metal part also.

Figure 7:
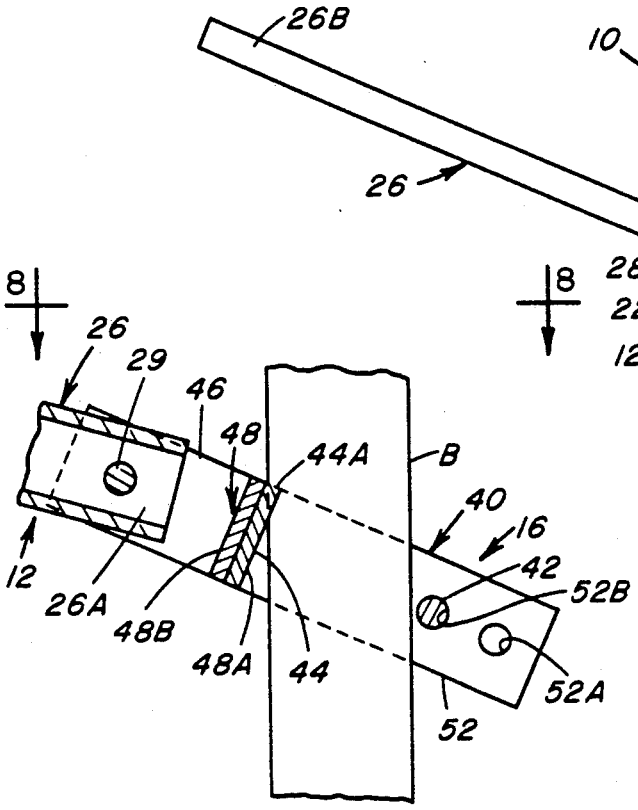
FIG. 7 is an enlarged fragmentary longitudinal sectional view of the apparatus illustrating the second working head engaged with the second type of post as seen in FIG. 6.
Figure 8:
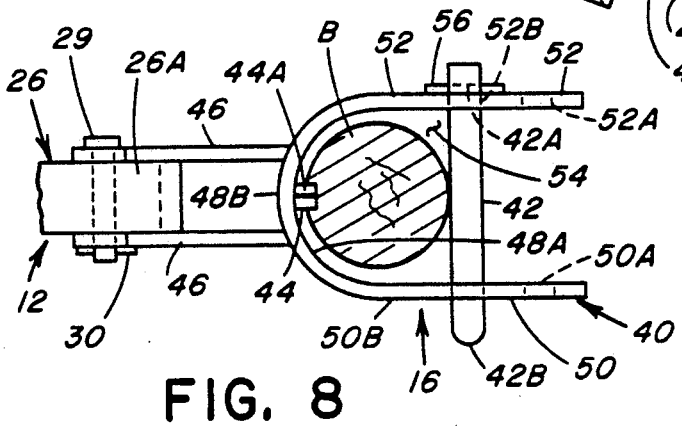
FIG. 8 is a fragmentary top plan view of the apparatus as seen along line 8—8 of FIG. 7.

As can be seen in FIGS. 7 and 8, with the post B extending through the channel 54, spaced portions defined on the guide member 40 and closure member 42 engage the post B at two locations spaced from one another axially along the post B and on opposite sides of the post B. Then, during each work-producing stroke of movement of the lever arm 26 of the actuating device 12 the second working head 16 at the two spaced portions thereon is forced against the post in a cocked engagement as the second working head 16 moves upwardly with the inner end 26A of the lever arm 26. The cocked engagement of the second working head 16 with the stationary post B causes binding of the planted post B in the channel 54 between the two spaced portions of the head 16, which results in penetrating of the post B by the piercing element 44, gripping of the post B by the head 16, and lifting and dislodging of the post from the ground. One portion of the head 16 which engages the post B is the bight portion 48 of the guide member 40 and the piercing element 44 thereon, whereas the other portion of the head 16 which engages the post B is closure member 42.

Figure 10:
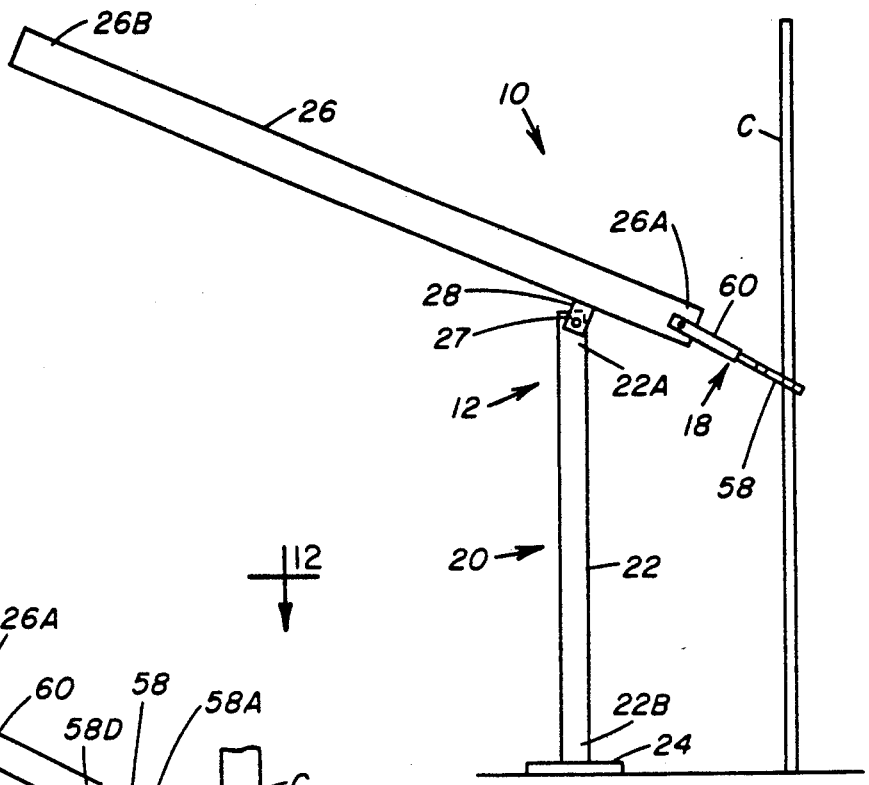
FIG. 10 is a side elevational view of the post pulling apparatus of the present invention employing a third of the working heads of FIG. 1 for pulling a third type of post.

Referring to FIGS. 10–13, there is illustrated the third working head 18 of the present invention being employed for pulling the rod-like electric fence post C as seen in FIG. 10. The third working head 18 is composed of a guide member 58 and a linking means 60. The guide member 58 is in the form of a flat plate having opposite upper and lower sides 58A and 58B and opposite front and rear ends 58C and 58D. The guide member 58 also has a pair of spaced front and rear apertures 62 and 64 defined through it with different diameter sizes for receiving rod-like posts C of different diameter sizes. The guide member 58 is capable of receiving the rod-like post C through a selected one of the front and rear apertures 62 and 64 and of engaging and lifting the post C during each work-producing stroke of movement of the lever arm 26 of the actuating device 12. As can be understood from FIG. 12, the diameter of the aperture 62 is larger than the diameter of the post C pulled by guide member 58 such that an annular gap 66 is present between the post C and an annular rim 68 defining the front aperture 62 so that the third working head 18 can easily be installed over and removed from the post C.

The linking means 60 is in the form of a generally C-shaped link rigidly attached and projecting from the rear end 58D of the guide member 58. A rear portion 60A of the link 60 inserts through the holes 26C of the lever arm 26 for pivotally attaching the third head 18 to the actuating device 12. In an exemplary embodiment, the guide member 58 and C-shaped link 60 are metal parts which are welded together to form the third head 18.

Figure 11:
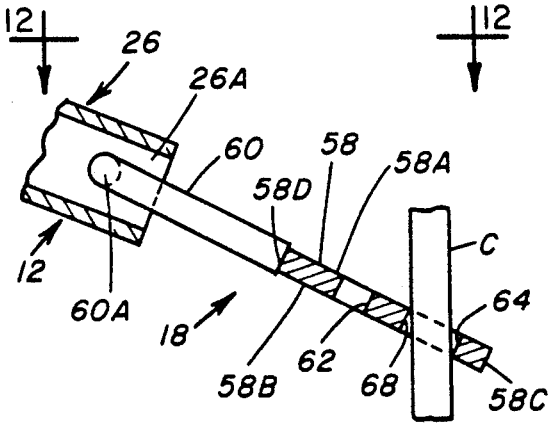
FIG. 11 is an enlarged fragmentary longitudinal sectional view of the apparatus illustrating the third working head engaged with the third type of post as seen in FIG. 10.
Figure 13:
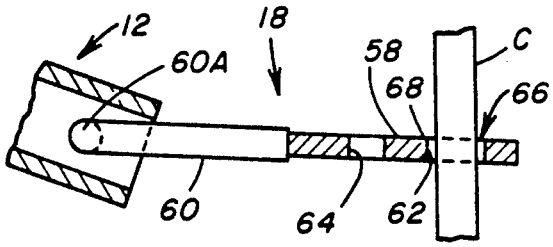
FIG. 13 is a view of the apparatus similar to that of FIG. 11 except showing the third working head disengaged from the third type of post.
Figure 12:
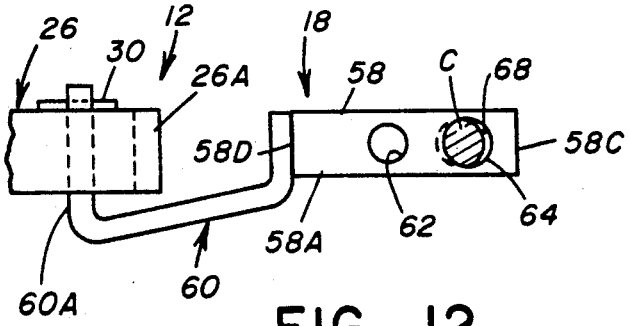
FIG. 12 is a fragmentary top plan view of the apparatus as seen along line 12—12 of FIG. 11.

As can be seen in FIGS. 11 and 12, with the post C extending through the front aperture 62, spaced portions on the guide member 58 engage the post C at two locations spaced from one another axially along the post C and on opposite sides of the post C. Then, during each work-producing stroke of movement of the lever arm 26 of the actuating device 12 the third working head 18 at the spaced portions thereon is forced against the post in a cocked engagement as the third working head 18 moves upwardly with the inner end 26A of the lever arm 26. The cocked engagement of the third working head 18 with the stationary post C causes binding of the planted post C in the aperture 62 between the spaced portions of the head 18, which results in gripping of the post C by the head 18, and lifting and dislodging of the post from the ground. The portions of the head 18 which engage the post C are opposite sides of the annular rim 68 defining the front aperture 62 through the guide member 58.

Also, since the rod-like electric fence post C is smaller in weight, length and diameter than the other posts, it is possible to remove the post C manually using the third head 18 without using the actuating device 12. In the latter case, a user grips the rear portion 60A of the C-shaped linking means 60, inserts the guide member 58 over the post, and pulls upwardly on the head 18 gripping the post.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A post pulling apparatus for pulling different types of posts, comprising:

(a) a universal actuating device repetitively operable through a succession of work-producing strokes of movement; and (b) a plurality of different working heads for pulling different types of posts, said different working heads being interchangeable with one another in a connected relation with said universal actuating device, said different working heads having respective spaced portions for engaging the different types of posts corresponding to said different working heads at two locations spaced from one another axially along and on opposite sides of the posts in order to lift the different types of posts during each work-producing stroke of movement of said actuating device, said spaced portions of each different working head being of different geometrical configuration than said spaced portions of the other different working heads.

2. The apparatus of claim 1 wherein said universal actuating device includes:

an upright support member having an upper end and a base mounted at a lower end for resting on the ground; and a lever arm having opposite ends and being pivotally mounted to said upper end of said support member at a location spaced substantially nearer to one of said opposite ends than the other of said opposite ends, said working head being pivotally attached to said one of said opposite ends of said lever arm.

3. The apparatus of claim 2 wherein said lever arm is a hollow tube of square cross-section and having a pair of transversely aligned holes at one end for coupling each of said working heads to said lever arm.

4. A post pulling apparatus for pulling different types of posts, comprising:

(a) a universal actuating device repetitively operable through a succession of work-producing strokes of movement; and (b) a plurality of working heads of different configurations for pulling different types of posts, said working heads being interchangeable with one another in a connected relation with said universal actuating device for coupling with and for engaging and lifting the different types of posts corresponding to said different working heads during each work-producing stroke of movement of said actuating device;

(c) a first of said working heads including (i) a support member having opposite upper and lower edges and opposite front and rear sides, (ii) means for pivotally linking said support member to said actuating device, and (iii) a pair of guide members rigidly attached to said front side of said support member closer to said lower edge than upper edge thereof and projecting in a converging relationship to one another from said front side of said support member so as to form with said support member a triangular-shaped channel for receiving and capturing a cross-sectional T-shaped post in said channel and for engaging and lifting the post during each work-producing stroke of movement of said actuating device.

5. The apparatus of claim 4 wherein said each working head has spaced portions that engage the respective type of post at two locations spaced from one another axially along the post and on opposite sides of the post such that by actuating said lever arm in a jacking-type motion said working head is forced into a cocked engagement against the post as said head is moved upwardly by said lever arm, causing binding of the post between said spaced portions of said head, which results in gripping of the post by said head and lifting and dislodging of the post from the ground.

6. The apparatus of claim 4 wherein said linking means is a pair of laterally spaced parallel links rigidly attached and projecting from said rear side of said support member closer to said upper edge than lower edge thereof, said links being pivotally attachable to said actuating device.

7. The apparatus of claim 4 wherein a second of said working heads includes:

a guide member having a bight portion with opposite front and rear sides and opposite leg portions rigidly attached to said bight portion and extending generally parallel to one another away from said front side of said bight portion, said leg portions having at least one pair of transversely aligned openings formed through said leg portions;

means for pivotally linking said guide member to said actuating device;

a closure member insertable through said aligned openings in said leg portions of said guide member so as to form with said guide member a channel for receiving and capturing a wood post in said channel; and a piercing element rigidly attached on said front side of said bight portion of said guide member and protruding within said channel, said piercing element having an upper edge capable of penetrating the wood post for lifting the post during each work-producing stroke of movement of said actuating device.

8. The apparatus of claim 7 wherein said linking means is a pair of laterally spaced parallel links rigidly attached and projecting from said rear side of said bight portion of said guide member, said links being pivotally attachable to said actuating device.

9. The apparatus of claim 4 wherein a second of said working heads includes:

a guide member having opposite upper and lower sides and opposite front and rear ends, said guide member having at least one aperture defined by an annular rim through said guide member of larger diameter than a rod-like post to be pulled by said guide member such that an annular gap is present between the post and said annular rim of said guide member defining said aperture; and means for pivotally linking said guide member to said actuating device;

said guide member being capable of receiving the post through said aperture thereof and of engaging and lifting the post during each work-producing stroke of movement of said actuating device.

10. The apparatus of claim 9 wherein said linking means is a generally arcuate link rigidly attached and projecting from said rear end of said guide member and being pivotally attachable to said actuating device.

11. A working head for pulling posts being connectable with an actuating device of a post pulling apparatus repetitively operable through work-producing strokes of movement, said head when connected with said actuating device being capable of engaging and lifting a cross-sectional T-shaped post during each work-producing stroke of movement of the actuating device, said working head comprising:

(a) a support member having opposite upper and lower edges and opposite front and rear sides, (b) means for pivotally linking said support member to the actuating device, and (c) a pair of guide members rigidly attached to said front side of said support member closer to said lower edge than upper edge thereof and projecting in a converging relationship to one another from said front side of said support member so as to form with said support member a triangular-shaped channel for receiving and capturing the post in said channel and for engaging and lifting the post during each work-producing stroke of movement of the actuating device.

12. The head of claim 11 wherein said linking means is a pair of laterally spaced parallel links rigidly attached and projecting from said rear side of said support member closer to said upper edge than lower edge thereof, said links being pivotally attachable to said actuating device.

13. The head of claim 11 wherein said support member and said pair of guide members define spaced portions engageable with the post at two locations spaced from one another axially along the post and on opposite sides of the post such that during each work-producing stroke of movement of the actuating device said head is forced into a cocked engagement against the post as said head is moved upwardly by the actuating device, causing binding of the post between said spaced portions of said head, which results in gripping of the post by said head and lifting and dislodging of the post from the ground.

14. A working head for pulling posts being connectable with an actuating device of a post pulling apparatus repetitively operable through work-producing strokes of movement, said head when connected with said actuating device being capable of engaging and lifting a wood post during each work-producing stroke of movement of the actuating device, said working head comprising:

(a) a U-shaped guide member having an arcuate-shaped bight portion with opposite front and rear sides and opposite generally straight leg portions rigidly attached to opposite ends of said arcuate-shaped bight portion and extending generally parallel to one another away from said front side of said bight portion, said leg portions having at least one pair of transversely aligned openings formed through said leg portions;

(b) means for pivotally linking said guide member to the actuating device;

(c) a closure member insertable through said aligned openings in said leg portions of said guide member so as to form with said guide member a channel for receiving and capturing the wood post in said channel; and (d) a piercing element rigidly attached at a central location on said front side of said arcuate-shaped bight portion of said guide member between and spaced from said leg portions and protruding within said channel, said element having an upper edge capable of penetrating the wood post for lifting the post during each work-producing stroke of movement of the actuating device.

15. The head of claim 14 wherein said linking means is a pair of laterally spaced parallel links rigidly attached and projecting from said rear side of said bight portion of said guide member, said links being pivotally attachable to the actuating device.

16. The head of claim 14 wherein said bight portion of said guide member and said closure member define spaced portions engageable with the post at two locations spaced from one another axially along the post and on opposite sides of the post such that during each work-producing stroke of movement of the actuating device said head is forced into a cocked engagement against the post as said head is moved upwardly by the actuating device, causing binding of the post between said spaced portions of said head and penetration of said piercing element into the post, which results in gripping of the post by said head and lifting and dislodging of the post from the ground.

17. A working head for pulling posts being connectable with an actuating device of a post pulling apparatus repetitively operable through work-producing strokes of movement, said head when connected with said actuating device being capable of engaging and lifting a rod-like post during each work-producing stroke of movement of the actuating device, said working head comprising:

(a) a guide member composed by a flat plate having opposite upper and lower sides and opposite front and rear ends, said guide member having at least one aperture defined by an annular rim through said flat plate of larger diameter than the rod-like post to be pulled by said guide member such that an annular gap is present between the post and said annular rim of said flat plate of said guide member defining said aperture; and (b) means for pivotally linking said guide member to the actuating device, said linking means being a generally C-shaped link having front and rear legs, said link at said front leg being rigidly attached to said rear end of said guide member so a to project therefrom, said link at said rear leg being pivotally attachable to the actuating device;

(c) said flat plate of said guide member being capable of receiving the post through said aperture thereof and of engaging and lifting the post during each work-producing stroke of movement of the actuating device.

18. The head of claim 17 wherein said internal rim of said guide member at opposite sides of said annular rim defining said aperture through said guide member defines spaced portions engageable with the post at two locations spaced from one another axially along the post and on opposite sides of the post such that during each work-producing stroke of movement of the actuating device said head is forced into a cocked engagement against the post as said head is moved upwardly by the actuating device, causing binding of the post between said spaced portions of said head, which results in gripping of the post by said head and lifting and dislodging of the post from the ground.

* * * * *